United States Patent [19]

Kobayashi et al.

[11] Patent Number: 4,824,330

[45] Date of Patent: Apr. 25, 1989

[54] VARIABLE-CAPACITY GAS COMPRESSOR

[75] Inventors: Takeshi Kobayashi; Junichi Asai, both of Chiba, Japan

[73] Assignee: Seiko Seiki Kabushiki Kaisha, Chiba, Japan

[21] Appl. No.: 32,063

[22] Filed: Mar. 27, 1987

[30] Foreign Application Priority Data

Mar. 28, 1986 [JP] Japan ..... 61-45773[U]
Mar. 31, 1986 [JP] Japan ..... 61-47590[U]

[51] Int. Cl.[4] ..... F04B 49/02; F04C 29/08
[52] U.S. Cl. ..... 417/295; 417/310
[58] Field of Search ..... 417/270, 295, 296, 310; 91/482; 418/78

[56] References Cited

U.S. PATENT DOCUMENTS 4,065,229 12/1977 Black ..... 417/270
4,557,670 12/1985 Inagaki ..... 417/299

FOREIGN PATENT DOCUMENTS 174516 3/1986 European Pat. Off. ..... 418/78
692727 6/1953 United Kingdom ..... 91/482
1231915 5/1971 United Kingdom ..... 91/482

*Primary Examiner*—William L. Freeh
*Attorney, Agent, or Firm*—Bruce L. Adams; Van C. Wilks

[57] ABSTRACT

A variable-capacity gas compressor comprising a cylinder front and rear side blocks attached to both ends of the cylinder, a control plate formed with a recess or suction port which communicates with a communication port in the front side block and thereby forms a path for gas to flow into a cylinder chamber. The control plate is secured to the inner side of the front side block so that it may rotate within a given angular range. A driving means for driving the control plate and a control mechanism for controlling the driving means are provided so that the gas comnpressor is able to increase the cooling efficiency in the passenger compartment of an automobile in the beginning period of operation and to subsequently prevent any excessive cooling during continuous operation.

12 Claims, 6 Drawing Sheets

3
5
7
21
23
24
2
9
4
17
6
18

VARIABLE-CAPACITY GAS COMPRESSOR

BACKGROUND OF THE INVENTION

The present invention relates to a variable-capacity gas compressor for use in, for example, an automotive air conditioner, and more particularly to a gas compressor which is capable of varying the cooling power during operation.

In general, a gas compressor used in an air conditioner of a passenger car is mounted besides the engine and is adapted to be driven by a crankshaft pulley of the engine through a V-belt. The compressor is provided with an electromagnetic clutch which selectively transmits the driving power from the engine to the compressor.

Therefore, the power of the gas compressor is increased in proportion to the speed of the engine. This means that, when the automobile is running at a high speed, the gas compressor is also driven at a high speed with the result that the air in the compartment is cooled excessively. In addition, power consumption also is increased correspondingly. (Cooling power characteristics of the gas compressors of this type are shown by broken-line curves in FIG. 7.)

In order to overcome these problems, the same applicant has filed copending U.S. application Ser. Nos. 902,419, and 902,421 which disclose gas compressors of variable-capacity type, capable of varying the volume of the compression chambers in accordance with the speed of the gas compressor.

A typical example of such variable-capacity gas compressors will be explained hereinunder. In this variable-capacity gas compressor, a control plate is provided on the inner surface of the front side block of the compressor, and a recess (suction port) which communicates with a communication port in the front side block and the cylinder chamber, is formed in the control plate. The control plate is adapted to be rotated through a predetermined angle by a driving means, so as to vary the volume of the gas which is sucked through the communication port in the front side block.

However, the compressor in which the capacity is varied by the control plate encounters the following problem. Namely, it takes a much longer time for this type of gas compressor to cool the air to a set temperature as compared with conventional gas compressors (compression chamber volume is constant) the characteristics of which are shown by the broken-line curve in FIG. 7. Thus, the known variable-capacity type gas compressor of the type described could not comply with the demand for quick cool down of air, which demand is particularly acute in daytime of the summer season. (line curve in FIG. 7).

The long time required for the variable-capacity compressor to cool the air down to the set temperature is attributable to the fact that the suction pressure in the suction chamber is maintained constant.

FIG. 9 is a graph which shows the values of cooling efficiency achieved by a variable-capacity type gas compressor which operates with the suction pressure in the suction chamber maintained at constant levels of 0.5, 1.0, 1.5 and 2.0 kg/cm$^2$.

As will be seen from the graph shown in FIG. 9, there is a tendency that the lower the suction pressure, the shorter the time required for cooling the air down to the set temperature. It is also understood that the set temperature can be lowered if the suction pressure can be reduced.

In view of the above-explained relationship between the suction pressure and the cooling efficiency, the present inventors have found that a highly practical variable-capacity gas compressor can be obtained by designing such that, in the beginning period of operation, the compressor operates with reduced suction pressure so as to provide a high cooling efficiency, whereas, after elapse of a predetermined time, the compressor operates with raised suction pressure, so as to prevent any excessive cooling of air, and have found that an ideal variable-capacity gas compressor can be obtained by designing such that, in the beginning period of operation before the set temperature is reached, the compressor operates with a fixed capacity as in the case of the conventional gas compressor, whereas, after the set temperature has been reached, the compressor operates with the capacity-varying function.

SUMMARY OF THE INVENTION

Accordingly, the main object of the present invention is to provide a variable-capacity gas compressor which is able to make the compression chamber drive at a large capacity for to obtain a predetermined temperature in the beginning period of operation and which is driven at the capacity depending on the room temperature after reaching the predetermined temperature.

More particularly, an object of the present invention is to provide a variable-capacity gas compressor, which is able to increase the cooling efficiency in the beginning period of operation, and which is able to prevent any excessive cooling of air during continuous operation, thereby to attain a remarkable reduction in the power consumption.

For these purposes, a variable-capacity gas compressor of this invention comprises a cylinder, front and rear side blocks attached to both ends of the cylinder, a control plate formed with a recess (suction port) which communicates with a communication port in the front side block and the cylinder chamber, and being secured to the inner side of the front side block for rotation within a given angular range, a driving means for driving the control plate, and a control mechanism for controlling the driving means.

DETAILED DESCRIPTION OF THE PREFERRED EMBODIMENTS

The device will be described through preferred embodiments with reference to the accompanying drawings.

Figure 1:
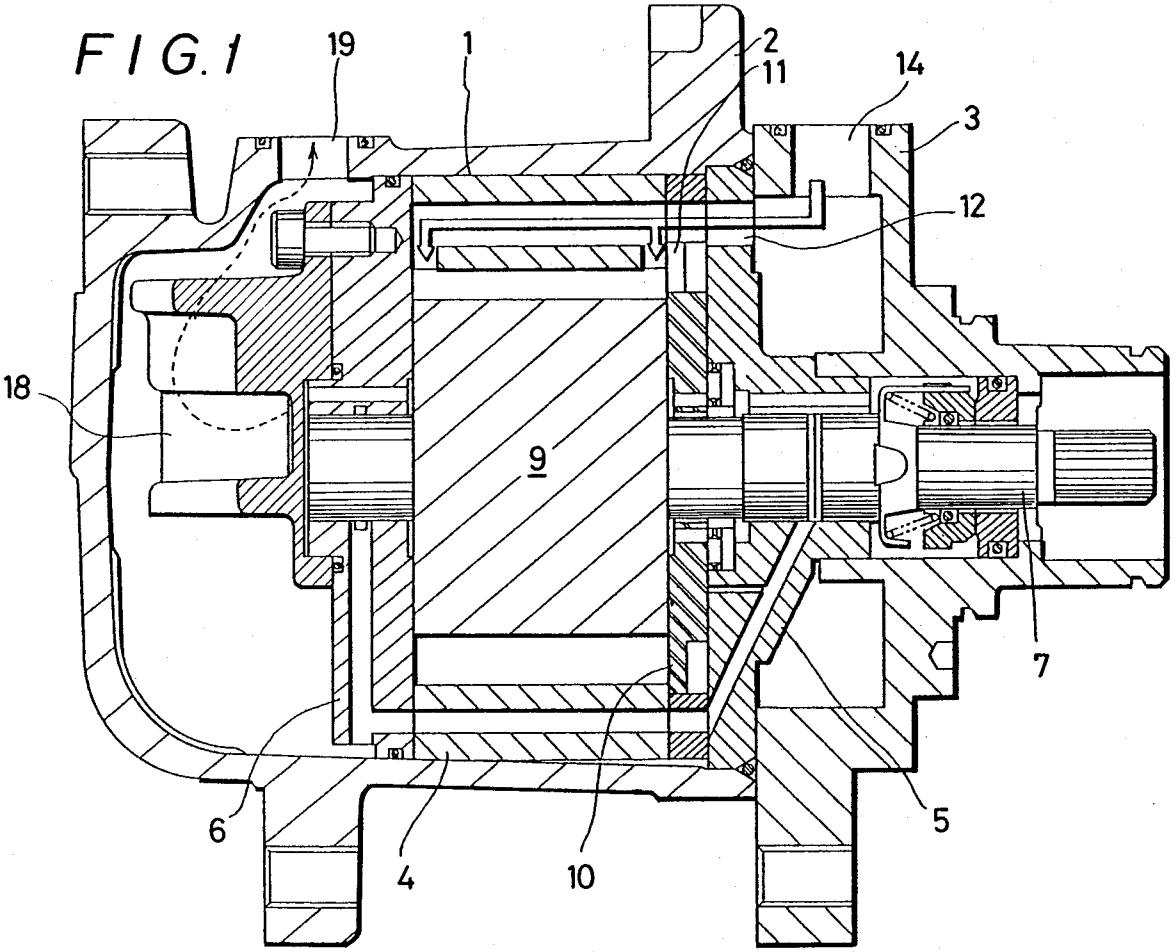
FIG. 1 is a longitudinal sectional view of the whole portion of a gas compressor in accordance with the present invention.
Figure 2:
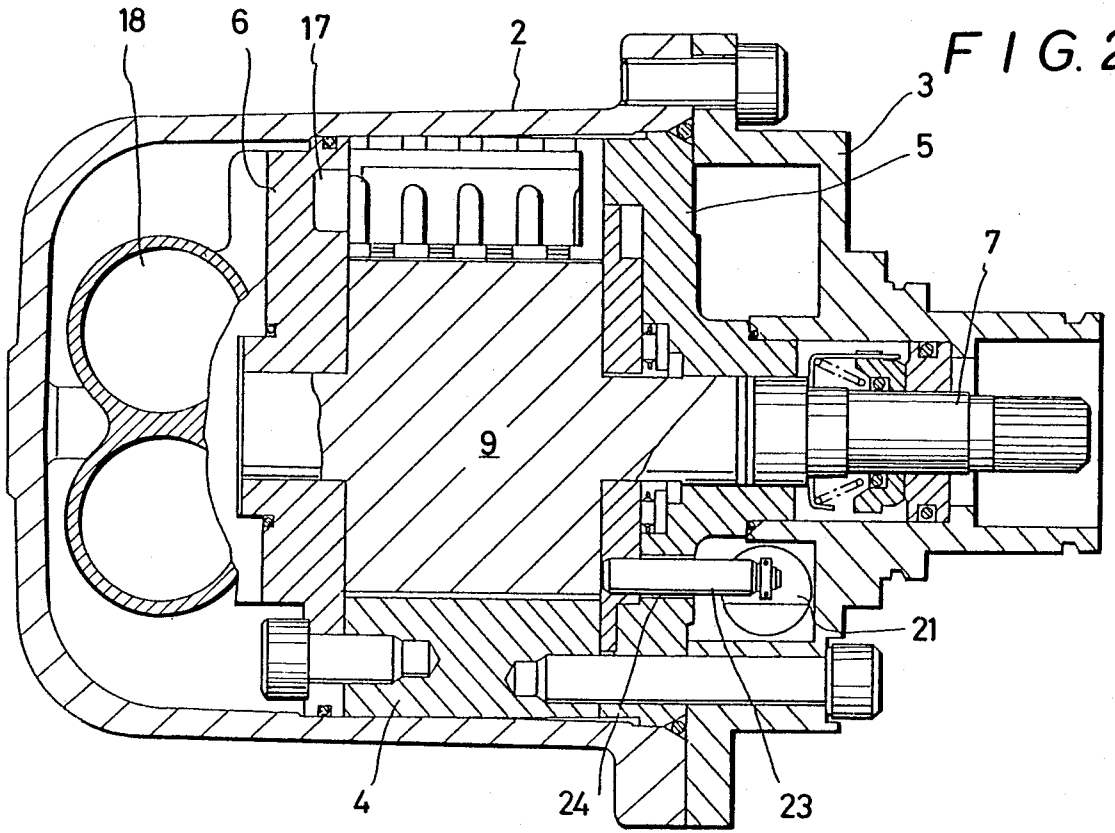
FIG. 2 is a cross-sectional view of the whole portion of the gas compressor shown in FIG. 1.

Referring to FIG. 1, the gas compressor has a main part or body 1, a casing 2 which hermetically encases the main part 1 and is opened at its one end, and a front head 3 which is secured to the open end of the casing 2.

The main part 1 includes a cylinder 4 having a substantially elliptic cylindrical inner peripheral surface, and front and rear side blocks 5 and 6 respectively, which are secured to both ends of the cylinder 4. The cylinder 4 and both side blocks 5 and 6 in combination form a substantially elliptic cylindrical cylinder chamber which rotatably receives a horizontal, solid and cylindrical rotor 9 integral with a rotor shaft 7 and provided with five vanes 8 which are movable in the radial direction of the rotor 9.

A substantially cylindrical control plate 10 is rotatably secured to the inner surface of the front side block 5. The control plate 10 is rotatable within a given angular range.

A recess 11 constituting a suction port is formed in a peripheral edge portion of the control plate 10. The recess 11 provides a communication between communication ports 12 in the front side block 5 and the cylinder chamber 13.

During high-speed operation of the compressor, the suction pressure tends to be lowered so that the recess 11 is moved as a result of rotation of the control plate 10. In consequence, the volume in the compression chamber is decreased causing the suction pressure to increase.

Conversely, during low-speed running of the compressor, the suction pressure is increased so that the control plate 10 is rotated in the reverse direction to move the recess 11, thereby to maximize the volume of the compression chamber. The rotation of the control plate is effected by a driving means which will be detailed later.

As the rotor 9 is rotated, a refrigerant gas of a low pressure, introduced through a suction port 14 formed in the front head 3, is sucked into the cylinder chamber 13 through the communication port 12 which is formed in the front side block 5 at 180° offset from the suction port, as indicated by the full-line arrow in FIG. 1. The refrigerant gas which has been compressed to a high pressure within the cylinder chamber 13 is discharged into the minute gap between the cylinder 4 and the inner peripheral surface of the casing 2, through a delivery port 15 and a delivery valve 16. The gas is then introduced into an oil separator 18 which is disposed behind the rear side block 6, via a communication port 17 which is formed in the rear side block 6 at 180° offset from the communication port 12. The gas is then discharged to the outside of the compressor past a rear space in the casing 2 and an outlet port 19.

A description will be made hereinunder as to the control plate driving means which constitutes an essential portion of the present invention.

A piston cylinder 21 is disposed in a suction chamber 20 which is formed between the front side block 5 and the front casing 3. The piston cylinder 21 has its longitudinal axis extended in the direction perpendicular to the axis of the compressor.

The piston cylinder 21 has an end 21*a* which confronts the suction chamber 20 and a rear side 21*b* which is exposed to the outside. The piston cylinder 21 has a bore receiving a spring 22 which exerts a pushing force suitable for normally biasing the piston cylinder 21 into the suction chamber 20.

A driving pin 23 is provided on the surface of the control plate 10 so as to protrude therefrom. The pin 23 extends through an arcuate cam groove 24 formed in the front side block 5 such that its end is exposed to the suction chamber 20. The end of pin 23 is received in an engaging recess 25 formed between a side and the end 21*a* of the piston cylinder 21, so that the movement of the piston cylinder 21 causes the driving pin 23 to be moved in the cam groove 24, thereby rotating the control plate 10 through a predetermined angle.

Next is the explanation of two embodiments of means for driving control of the piston cylinder 21 of this invention.

Figure 3:
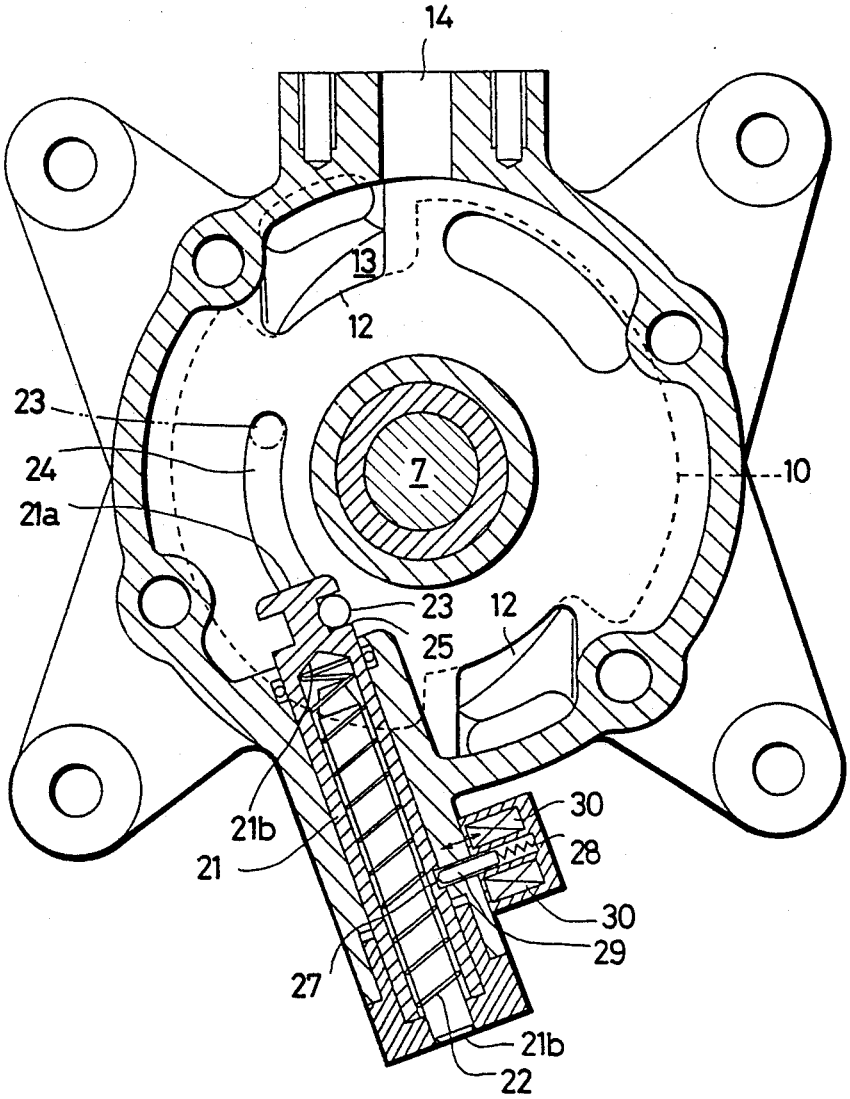
FIG. 3 and FIG. 4 are longitudinal sectional views of a driving means for driving a control plate which constitutes an essential portion of the gas compressor.

FIG. 3 shows one embodiment, namely the gas compressor in accordance with the present invention has piston cylinder locking means for locking the piston cylinder under a given condition and unlocking means for unlocking the piston cylinder.

A description will be given hereinafter using FIG. 3 as to the piston cylinder locking means and unlocking means. The piston cylinder 21 is provided in the side surface thereof with an engaging hole 27. A spool 29 biased by a spring 28 is adapted to engage with the engaging hole 27. Normally, the piston cylinder 21 is securely locked because the spool 29 engages with the engaging hole 27. In this state, the control plate 10 also is fixed so that the volume of the compression chamber 13 is maintained at the maximum value.

In order to unlock the piston cylinder 21, the described embodiment incorporates solenoid coils 30, 30 disposed on both sides of the spool 29. As these solenoid coils 30, 30 are energized, the spool 29 is attracted in the direction of the arrow shown in FIG. 3 against the force of the spring 28, thereby disengaging the spool 29 from the engaging hole 27, thus allowing the piston cylinder 21 to be moved back and forth.

The supply of the electric power to the solenoid coil 30 may be commenced in response to a signal from a temperature sensor (not shown) disposed in the passenger compartment and adapted for sensing the air temperature in the passenger compartment or, alternatively, in response to a signal from a sensor which senses the temperature of air from an evaporator (not shown).

Thus, according to the present invention, the temperature of air in the passenger compartment or from the evaporator is detected by a suitable sensor disposed therearound. The state of the piston cylinder 21 is controlled in accordance with the signal from the sensor such that, before the air temperature reaches a predetermined temperature, the piston cylinder 21 is locked by the locking means so that the compressor operates to effect quick cooling, but the solenoid 30 is energized to unlock the piston cylinder 21 so as to enable the piston cylinder 21 to move back and forth after the predetermined air temperature has been reached.

In the unlocked state, the piston cylinder 21 is moved back and forth in accordance with the difference between the set pushing force of the spring 22 and the force produced by the suction pressure in the suction chamber 20. As a result of the movement of the piston cylinder 21, the control plate 10 rotates through a predetermined angle about its axis so as to move the recess (suction port) 11 continuously, thus varying the volume of the compression chamber 13, and thereby maintaining the suction pressure in the suction chamber substantially at the constant level which is preferably about 2 $kg/cm^2$.

Figure 5:
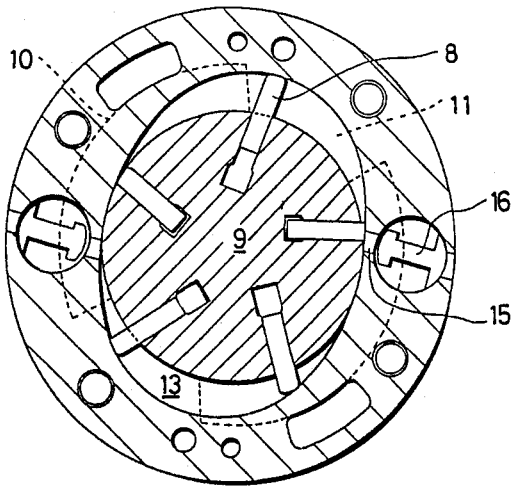
FIG. 5 is a longitudinal sectional view of the gas compressor in the state of high-speed running.
Figure 6:
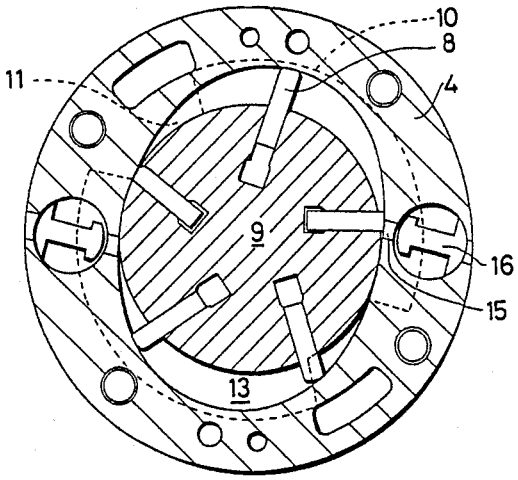
FIG. 6 is a longitudinal sectional view of the gas compressor in the state of low-speed operation.
Figure 7:
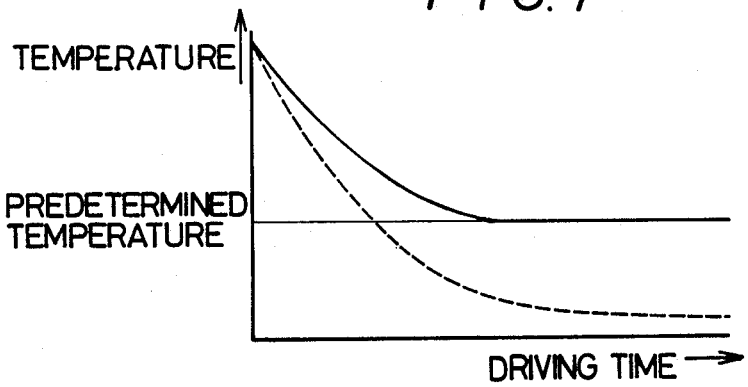
FIG. 7 is a graph illustrating the cooling power as obtained in a conventional gas compressor, and (shown by broken-line curve).

FIG. 5 shows the position of the control plate 10 during high-speed operation of the compressor, while FIG. 6 shows the position of the control plate during low-speed operation of the compressor.

Figure 8:
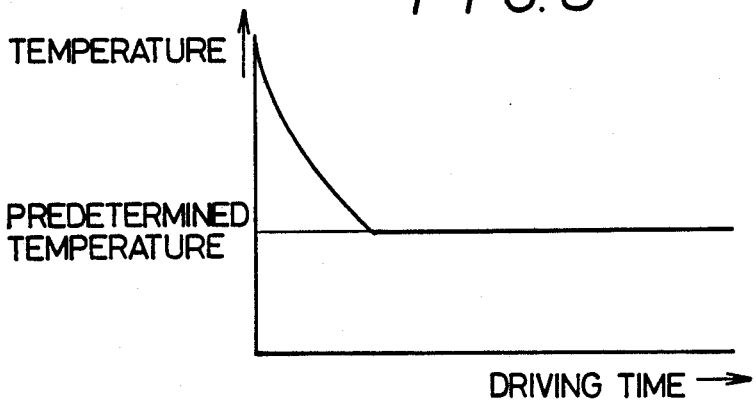
FIG. 8 and FIG. 9 are graphs showing the cooling power as obtained in the gas compressor in accordance with the present invention.
Figure 9:
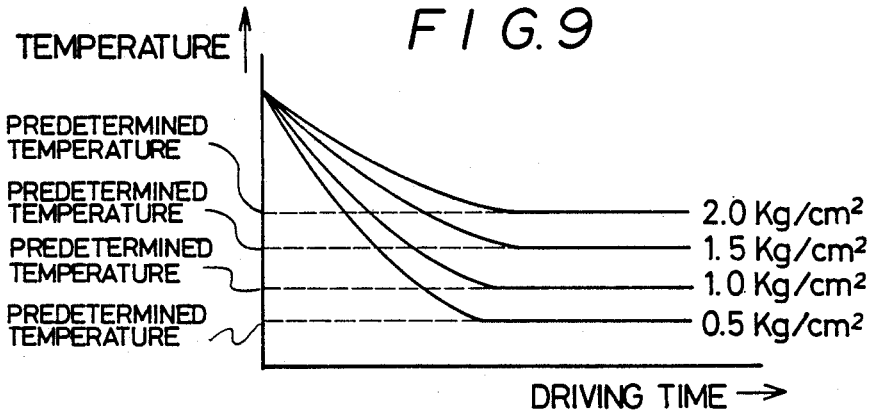

FIG. 8 shows the cooling power characteristics of the gas compressor in accordance with the present invention.

Figure 4:
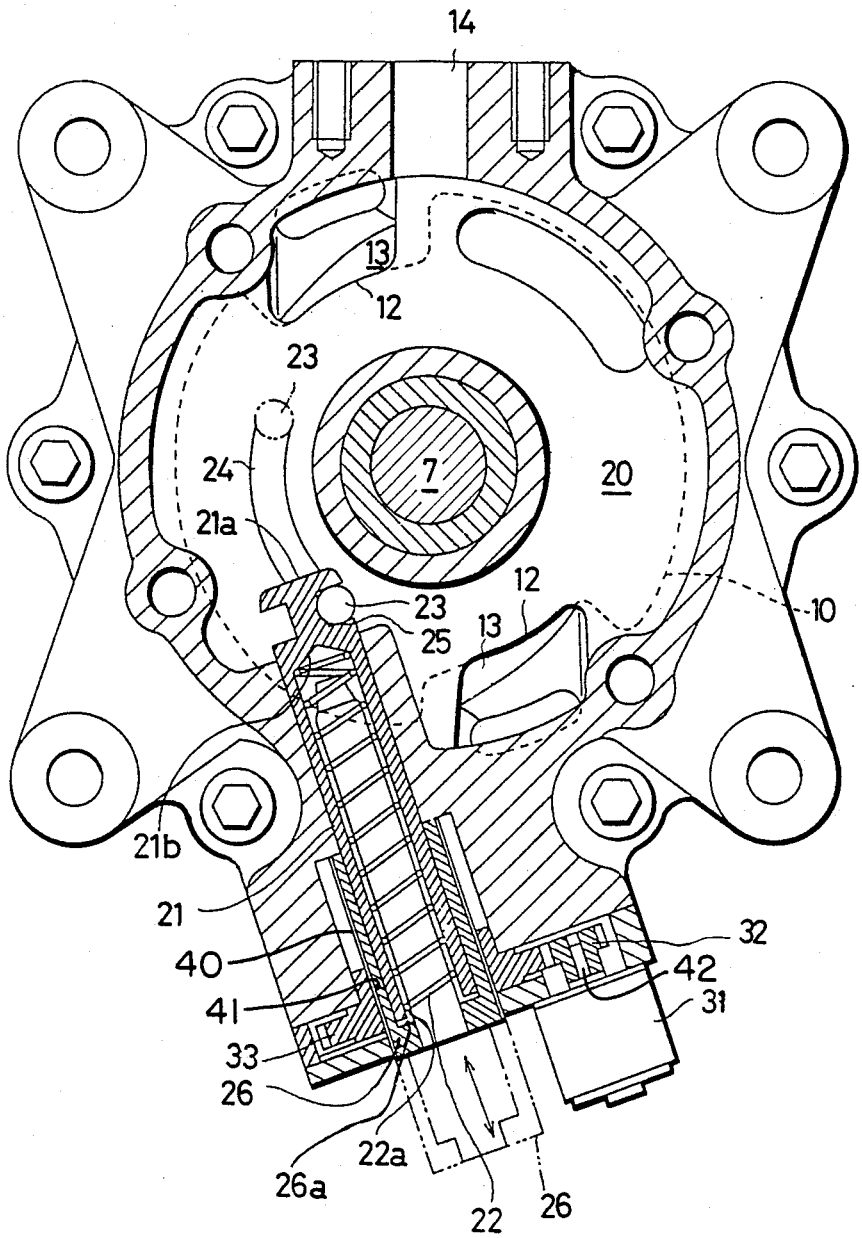

FIG. 4 shows other another embodiment. In FIG. 4, a spring pressure adjusting means is provided for adjusting the force of the spring 22.

More specifically, in the FIG. 4 embodiment of the invention, the spring 22 is disposed such that its rear end 22*a* abuts the bottom surface 26*a* of a hollow cylindrical casing 26 which is provided around the rear peripheral portion of the piston cylinder 21. As the casing 26 is moved back and forth as indicated by the arrows in FIG. 4, the length of the spring 22 and, hence, the force exerted by the spring 22 is adjusted.

To this end, according to the device of the invention, a conventional external gear device 40, such as a helix or the like, formed on the outer peripheral surface of the hollow cylindrical casing. 26 meshes with an internal gear device 41 on a driven gear 33 which in turn meshes with a driving gear 32 which is fixed to the output shaft 42 of a driving motor 31, so that the hollow cylindrical casing 26 is moved back and forth as the driven gear 33 is rotated at the constant position.

In consequence, the hollow cylindrical casing 26 is adapted to move either backward or forward by a predetermined distance in accordance with the direction and speed of rotation of the shaft 42 of the driving motor 31.

A description will be made hereinunder as to the operation of the FIG. 4 spring pressure adjusting means.

In the beginning period of operation of the compressor, there is a demand for quick cooling of the air in the compartment, so that the passenger suction pressure in the compression chamber 13 is preferably maintained at a high level. To this end, it is necessary that the spring 22 is set to produce comparatively small force.

Referring to FIG. 4, the-dot-and-dash line shows the casing 26 which has been projected or expanded, so that the spring 22 acting on the bottom surface 26*a* of the casing 26 produces comparatively small force. In this state, the piston cylinder 21 is moved back and forth in accordance with the difference between the set force of the spring 22 and the force produced by the suction pressure in the suction chamber 20.

If the compressor is operated continuously with the thus adjusted spring force, i.e., with the reduced suction pressure in the suction chamber, the air in the passenger compartment will be cooled excessively. To avoid this, it is desirable that the suction pressure in the suction chamber 20 is maintained at a comparatively high level. To this end, the motor 31 is operated to contract or shift the casing 26 forward to withdrawn the position shown by full lines and this by the operation of the motor 31, through the driving gear 32, the driven gear 33, and gear devices 40, 41. This forward movement of the casing 26 causes the spring 22 to be compressed correspondingly, so that the spring 22 can produce a greater force. The piston cylinder 21 is then moved forward or backward in accordance with the difference between the increased force of the spring 22 and the force produced by the suction pressure in the suction chamber, whereby a substantially constant suction pressure is maintained within the suction chamber 20.

A sensor (not shown) provided in the passenger compartment or in the vicinity of an evaporator senses the ambient air temperature, and the arrangement is such that the driving motor 31 starts to operate when the air temperature sensed by the sensor has reached a predetermined level.

As has been described above, according to the present invention, there is provided a gas compressor which makes use of the advantages proposed by both the functions of non-variable and variable capacity gas compressors. In the beginning period of the operation, the driving of the control plate is prohibited by the piston cylinder locking means so that the compressor cools quickly by making use of the advantage of the conventional gas compressors, whereas, when the predetermined air temperature has been reached, the piston cylinder is unlocked with the locking means allowing the control plate to be rotated, so that the capacity of the compression chamber is limited to prevent any excessive cooling of air.

In the beginning period of operation, the suction pressure of the compressor is set at a comparatively low level and at a comparatively high level during continuous operation, and the set levels of the suction pressure are maintained by varying the volume of the compression chamber through rotation of the control plate.

Therefore, high cooling efficiency is obtained in the beginning period of operation so as to meet the demand for quick cooling down of the passenger compartment air to moderate temperature even in the daytime of summer season in which such a demand is critical. At the same time, during long continuous operation, the undesirable excessive cooling of the compartment air is avoided while the power consumption is reduced. Thus, the present invention provides a gas compressor which has a high utility.

What is claimed is:

1. A variable-capacity gas compressor for use with an automobile air conditioning system for cooling the automobile passenger compartment, comprising:

a cylinder;

front and rear side blocks attached to ends of said cylinder;

a rotor disposed horizontally for rotation within said cylinder and having a plurality of vanes slidable in the radial direction;

a control plate formed with a recess which communicates with a communication port in the front side block and a cylinder chamber, and secured to the inner side of said front side block for rotation within a given angular range;

a driving means for driving said control plate, having a front end thereof connected to said control plate and a rear end thereof exposed to the outside of the compressor and thus to atmospheric pressure, a piston cylinder which moves into and out of a suction chamber and a spring which urges said piston cylinder into said suction chamber; and a control means for enabling said piston cylinder to actuate in accordance with the temperature in the passenger compartment to thus control said driving means and said control plate.

2. The compressor according to claim 1 wherein, said control means comprises a piston cylinder locking means for locking said piston cylinder against movement.

3. The compressor according to claim 2 wherein, said piston cylinder locking means includes a spool and a solenoid coil operating said spool.

4. The compressor according to claim 3 wherein, said solenoid coil is operated by signals from a sensor which is disposed in the passenger compartment or near an evaporator.

5. The compressor according to claim 1 wherein, said control means comprises a spring pressure adjusting means for variably adjusting the force of said spring.

6. The compressor according to claim 5 wherein;

said spring pressure adjusting means comprises a driving motor, a driving gear fixed to an output shaft of said driving motor, a driven gear meshed with said driving gear, and a hollow cylindrical casing provided around a rear peripheral portion of said piston cylinder, and having an outer peripheral surface formed with a gear device which is meshed with an internal gear device on said driven gear.

7. A gas compressor of the variable volume type for use with an automobile air conditioning system for cooling the automobile passenger compartment, comprising:

a cylinder formed on its interior into a substantially elliptic shape and having front and rear side blocks attached to ends of the cylinder;

a rotor disposed horizontally for rotation within said cylinder and having a plurality of vanes slidable in the radial direction;

a control plate formed with at least one recess which communications with at least one communication port formed in the front side block and a cylinder chamber formed in the cylinder, said control plate being secured to the inner side of said front side block for rotation within a given angular range;

a driving means for driving said control plate, said driving means having a front end thereof connected to said control plate and a rear end thereof exposed outside said compressor, said driving means including piston cylinder means for controlling movement of said control plate, said piston cylinder means including a spring which normally urges said piston cylinder means into a suction chamber; and a control means for actuating said piston cylinder means in accordance with the temperature in the passenger compartment.

8. The compressor according to claim 7, wherein said control means comprises electrically responsive piston cylinder locking means for locking said piston cylinder means against movement.

9. The compressor according to claim 8, wherein said electrically responsive piston cylinder locking means includes a spool member and a solenoid coil which operates said spool member.

10. The compressor according to claim 9, wherein said solenoid coil is operated by electrical signals from a sensor which is placed in the passenger compartment or near an evaporator.

11. The compressor according to claim 7, wherein said control means comprises a spring pressure adjusting means for variably adjusting the force of said spring.

12. The compressor according to claim 11, wherein said spring pressure adjusting means comprises a driving motor, a driving gear fixed to an output shaft of said driving motor, a driven gear meshed with said driving gear, a hollow cylindrical casing surrounding a rear peripheral portion of said piston cylinder means, said hollow cylindrical casing having an outer peripheral surface formed with a gear device which cooperates with an internal gear device on said driven gear to move said hollow cylindrical casing toward and away from said suction chamber thereby variably adjusting said spring pressure.

* * * * *